US010724770B2

(12) United States Patent
Kniffler et al.

(10) Patent No.: US 10,724,770 B2
(45) Date of Patent: Jul. 28, 2020

(54) HEAT PUMP WITH A MOTOR COOLING ARRANGEMENT

(71) Applicant: Efficient Energy GmbH, Feldkirchen (DE)

(72) Inventors: Oliver Kniffler, Sauerlach (DE); Holger Sedlak, Sauerlach (DE)

(73) Assignee: EFFICIENT ENERGY GMBH, Feldkirchen (DE)

( * ) Notice: Subject to any disclaimer, the term of this patent is extended or adjusted under 35 U.S.C. 154(b) by 142 days.

(21) Appl. No.: 16/114,480

(22) Filed: Aug. 28, 2018

(65) Prior Publication Data

US 2018/0363959 A1 Dec. 20, 2018

Related U.S. Application Data

(63) Continuation of application No. PCT/EP2017/054626, filed on Feb. 28, 2017.

(30) Foreign Application Priority Data

Mar. 2, 2016 (DE) ..... 10 2016 203 408

(51) Int. Cl.
*F25B 30/02* (2006.01)
*F25B 31/00* (2006.01)
*F25B 39/00* (2006.01)

(52) U.S. Cl.
CPC ..... *F25B 30/02* (2013.01); *F25B 31/008* (2013.01); *F25B 39/00* (2013.01); *F25B 2339/047* (2013.01); *F25B 2400/071* (2013.01)

(58) Field of Classification Search
None
See application file for complete search history.

(56) References Cited

U.S. PATENT DOCUMENTS 3,805,101 A 4/1974 Purman
4,459,820 A * 7/1984 Giuffrida ..... F25B 31/00 62/238.6

(Continued)

FOREIGN PATENT DOCUMENTS

CN 1216098 A 5/1999
CN 104903676 A 9/2015

(Continued)

OTHER PUBLICATIONS

Japanese language office action dated Oct. 8, 2019, issued in application No. JP 2018-545914, and its English language translation.

(Continued)

*Primary Examiner* — Henry T Crenshaw
(74) *Attorney, Agent, or Firm* — McClure, Qualey & Rodack, LLP.

(57) ABSTRACT

A heat pump includes a condenser having a condenser housing; a compressor motor mounted on the condenser housing and having a rotor and a stator, the rotor having a motor shaft which has a compressor wheel for compressing working medium vapor mounted thereon, and the compressor motor having a motor wall; a motor housing which surrounds the compressor motor and has a working medium intake so as to direct liquid working medium out of the condenser to the motor wall for the purpose of cooling the motor, wherein the motor housing is further configured to form a vapor space during operation of the heat pump, and wherein the motor housing further has a vapor discharge outlet for discharging vapor from the vapor space within the motor housing.

15 Claims, 11 Drawing Sheets

(56) References Cited

U.S. PATENT DOCUMENTS

| | | | | |
|---|---|---|---|---|
| 5,520,008 | A | 5/1996 | Ophir et al. | |
| 6,070,421 | A * | 6/2000 | Petrovich | F04D 25/16 62/210 |
| 9,803,899 | B2 | 10/2017 | Holger et al. | |
| 2007/0245759 | A1 | 10/2007 | Sedlak et al. | |
| 2015/0013353 | A1* | 1/2015 | Becker | F25B 9/008 62/79 |

FOREIGN PATENT DOCUMENTS

| | | | |
|---|---|---|---|
| DE | 23 31 493 | A1 | 1/1974 |
| DE | 44 318 87 | A1 | 3/1995 |
| DE | 11 2010 001 944 | T5 | 9/2012 |
| EP | 2016349 | B1 | 1/2009 |
| JP | S55-83653 | U | 6/1980 |
| JP | S56-105257 | A | 8/1981 |
| JP | 2000-512725 | A | 9/2000 |
| JP | 2008-082622 | A | 4/2008 |
| KR | 970070845 | E | 11/1997 |
| WO | 2009/121548 | A1 | 10/2009 |
| WO | 2010/141572 | A1 | 12/2010 |
| WO | 2014/072239 | A1 | 5/2014 |
| WO | 2015072239 | A1 | 5/2014 |
| WO | 2014/089551 | A1 | 6/2014 |

OTHER PUBLICATIONS

International Search Report and Written Opinion for PCT/EP2017/054626 dated May 15, 2017.

English translation of the Chinese Office Action dated Apr. 20, 2020, issued in application No. 201780027288.3.

* cited by examiner $p4 \geqslant p3 > p2 > p1$

- vapor flows from the high pressure (p4) to the low pressure p1 within the rear space of the radial impeller;

→ <u>convective shaft cooling</u> of the motor shaft through the motor gap and the further gap;

schematic bottom view of the cap

| P[hPa] | 8 | 12 | 30 | 60 | 100 | 1000 |
|---|---|---|---|---|---|---|
| evap. temp. | 4°C | 12°C | 24°C | 36°C | 45°C | 100°C |

HEAT PUMP WITH A MOTOR COOLING ARRANGEMENT

CROSS-REFERENCES TO RELATED APPLICATIONS

This application is a continuation of copending International Application No. PCT/EP2017/054626, filed Feb. 28, 2017, which is incorporated herein by reference in its entirety, and additionally claims priority from German Application No. DE 10 2016 203 408.1, filed Mar. 2, 2016, which is incorporated herein by reference in its entirety.

The present invention relates to heat pumps for heating, cooling or for any other application of a heat pump.

BACKGROUND OF THE INVENTION

FIG. 8A and FIG. 8B provide a heat pump as is described in European Patent EP 2016349 B1. The heat pump initially includes an evaporator 10 for evaporating water as a working liquid so as to generate vapor within a working vapor line 12 on the output side. The evaporator includes an evaporation space (evaporation chamber) (not shown in FIG. 8A) and is configured to generate an evaporation pressure smaller than 20 hPa within said evaporation space, so that at temperatures below 15° C. within the evaporation space, the water will evaporate. The water is, e.g., ground water, brine, i.e. water having a certain salt content, which freely circulates in the earth or within collector pipes, river water, lake water or sea water. Any types of water, i.e. limy water, lime-free water, salty water or salt-free water, may be used. This is due to the fact that any types of water, i.e. all of said "water materials" have the favorable water property that water, which is also known as "R 718", has an enthalpy difference ratio of 6 that can be used for the heat pump process, which corresponds to more than double the typical enthalpy difference ratio of, e.g., R134a.

Through the suction line 12, the water vapor is fed to a compressor/condenser system 14 comprising a fluid flow machine (turbo-machine) such as a radial compressor, for example in the form of a turbocompressor, which is designated by 16 in FIG. 8A. The fluid flow machine is configured to compress the working vapor to a vapor pressure at least larger than 25 hPa. 25 hPa corresponds to a condensation temperature of about 22° C., which may already be a sufficient heating flow temperature of an underfloor heating system. In order to generate higher flow temperatures, pressures larger than 30 hPa may be generated by means of the fluid flow machine 16, a pressure of 30 hPa having a condensation temperature of 24° C., a pressure of 60 hPa having a condensation temperature of 36° C., and a pressure of 100 hPa having a condensation temperature of 45° C. Underfloor heating systems are designed to be able to provide sufficient heating with a flow temperature of 45° C. even on very cold days.

The fluid flow machine is coupled to a condenser 18 configured to condense the compressed working vapor. By means of the condensing process, the energy contained within the working vapor is fed to the condenser 18 so as to then be fed to a heating system via the advance 20*a*. Via the backflow 20*b*, the working liquid flows back into the condenser.

In accordance with the invention, it is advantageous to directly withdraw the heat (energy), which is absorbed by the heating circuit water, from the high-energy water vapor by means of the colder heating circuit water, so that said heating circuit water heats up. In the process, a sufficient amount of energy is withdrawn from the vapor so that said stream is condensed and also is part of the heating circuit.

Thus, introduction of material into the condenser and/or the heating system takes place which is regulated by a drain 22 such that the condenser in its condenser space has a water level which remains below a maximum level despite the continuous supply of water vapor and, thus, of condensate.

As was already explained, it is advantageous to use an open circuit, i.e. to evaporate the water, which represents the heat source, directly without using a heat exchanger. However, alternatively, the water to be evaporated might also be initially heated up by an external heat source via a heat exchanger. In addition, in order to also avoid losses for the second heat exchanger, which has expediently been present on the condenser side, the medium can also used directly, and for example when one thinks of a house comprising an underfloor heating system, the water coming from the evaporator can be allowed to directly circulate within the underfloor heating system.

Alternatively, however, a heat exchanger supplied by the advance 20*a* and exhibiting the backflow 20*b* may also be arranged on the condenser side, said heat exchanger cooling the water present within the condenser and thus heating up a separate underfloor heating liquid, which typically will be water.

Due to the fact that water is used as the working medium and due to the fact that only that portion of the ground water that has been evaporated is fed into the fluid flow machine, the degree of purity of the water does not make any difference. Just like the condenser and the underfloor heating system, which is possibly directly coupled, the fluid flow machine is supplied with distilled water, so that the system has reduced maintenance requirements as compared to today's systems. In other words, the system is self-cleaning since the system only ever has distilled water supplied to it and since the water within the drain 22 is thus not contaminated.

In addition, it shall be noted that fluid flow machines exhibit the property that they—similar to the turbine of a plane—do not bring the compressed medium into contact with problematic substances such as oil, for example. Instead, the water vapor is merely compressed by the turbine and/or the turbocompressor, but is not brought into contact with oil or any other medium impairing purity, and is thus not soiled.

The distilled water discharged through the drain thus can readily be re-fed to the ground water—if this does not conflict with any other regulations. Alternatively, it can also be made to seep away, e.g. in the garden or in an open space, or it can be fed to a sewage plant via the sewer system if this is stipulated by regulations.

Due to the combination of water as the working medium with the enthalpy difference ratio, the usability of which is double that of R134a, and due to the thus reduced requirements placed upon the closed nature of the system and due to the utilization of the fluid flow machine, by means of which the compression factors that may be used are efficiently achieved without any impairments in terms of purity, an efficient and environmentally neutral heat pump process is provided.

FIG. 8B shows a table for illustrating various pressures and the evaporation temperatures associated with said pressures, which results in that relatively low pressures are to be selected within the evaporator in particular for water as the working medium.

DE 4431887 A1 discloses a heat pump system comprising a light-weight, large-volume high-performance centrifugal compressor. Vapor which leaves a compressor of a second stage exhibits a saturation temperature which exceeds the ambient temperature or the temperature of a cooling water that is available, whereby heat dissipation is enabled. The compressed vapor is transferred from the compressor of the second stage into the condenser unit, which consists of a granular bed provided inside a cooling-water spraying means on an upper side supplied by a water circulation pump. The compressed water vapor rises within the condenser through the granular bed, where it enters into a direct counter flow contact with the cooling water flowing downward. The vapor condenses, and the latent heat of the condensation that is absorbed by the cooling water is discharged to the atmosphere via the condensate and the cooling water, which are removed from the system together. The condenser is continually flushed, via a conduit, with non-condensable gases by means of a vacuum pump.

WO 2014072239 A1 discloses a condenser having a condensation zone for condensing vapor, that is to be condensed, within a working liquid. The condensation zone is configured as a volume zone and has a lateral boundary between the upper end of the condensation zone and the lower end. Moreover, the condenser includes a vapor introduction zone extending along the lateral end of the condensation zone and being configured to laterally supply vapor that is to be condensed into the condensation zone via the lateral boundary. Thus, actual condensation is made into volume condensation without increasing the volume of the condenser since the vapor to be condensed is introduced not only head-on from one side into a condensation volume and/or into the condensation zone, but is introduced laterally and, advantageously, from all sides. This not only ensures that the condensation volume made available is increased, given identical external dimensions, as compared to direct counterflow condensation, but that the efficiency of the condenser is also improved at the same time since the vapor to be condensed that is present within the condensation zone has a flow direction that is transverse to the flow direction of the condensation liquid.

What is generally problematic about heat pumps is the fact that movable parts and, in particular, fast-moving parts are to be cooled. What is particularly problematic here are the compressor motor and, specifically, the motor shaft. Specifically for heat pumps for which radial impellers are used as the compressors, which radial impellers are operated very fast, e.g. within ranges larger than 50,000 revolutions per minute, in order to achieve a small design, shaft temperatures may reach values which are problematic since they may result in destruction of the components.

SUMMARY

According to an embodiment, a heat pump may have: a condenser having a condenser housing; a compressor motor mounted on the condenser housing and having a rotor and a stator, the rotor having a motor shaft which has a compressor wheel for compressing working medium vapor mounted thereon, and the compressor motor having a motor wall; a motor housing which surrounds the compressor motor and has a working medium intake so as to direct liquid working medium out of the condenser to the motor wall for cooling the motor, wherein the motor housing is configured to maintain a maximum level of liquid working medium within the motor housing during operation of the heat pump, wherein the motor housing is further configured to form a vapor space above the maximum level during operation of the heat pump, and wherein the motor housing further has a vapor discharge outlet for discharging vapor from the vapor space within the motor housing into the condenser.

According to another embodiment, a method of producing a heat pump having: a condenser having a condenser housing; a compressor motor mounted on the condenser housing and having a rotor and a stator, the rotor having a motor shaft which has a compressor wheel for compressing working medium vapor mounted thereon, and the compressor motor having a motor wall; a motor housing which surrounds the compressor motor and has a working medium intake so as to direct liquid working medium out of the condenser to the motor wall for cooling the motor, may have the steps of: configuring the motor housing such that it maintains a maximum level of liquid working medium within the motor housing during operation of the heat pump and that it forms a vapor space above the maximum level during operation of the heat pump; and arranging a vapor discharge outlet within the motor housing for discharging vapor from the vapor space within the motor housing into the condenser.

According to another embodiment, a method of operating a heat pump having: a condenser having a condenser housing; a compressor motor mounted on the condenser housing and having a rotor and a stator, the rotor having a motor shaft which has a compressor wheel for compressing working medium vapor mounted thereon, and the compressor motor having a motor wall; a motor housing which surrounds the compressor motor and has a working medium intake so as to direct liquid working medium out of the condenser to the motor wall for cooling the motor, the motor housing being configured to maintain a maximum level of liquid working medium within the motor housing during operation of the heat pump, and the motor housing being further configured to form a vapor space above the maximum level during operation of the heat pump, may have the steps of: during operation of the heat pump, discharging vapor from the vapor space within the motor housing into the condenser.

The heat pump in accordance with one aspect of the present invention includes specific convective shaft cooling. Said heat pump comprises a condenser having a condenser housing, a compressor motor mounted on the condenser housing, and a rotor as well as a stator, the rotor comprising a motor shaft having a radial impeller mounted thereon which extends into an evaporator zone, and a routing space configured to receive vapor that is compressed by the radial impeller and to route same into the condenser. In addition, said heat pump comprises a motor housing which surrounds the compressor motor and is advantageously configured to maintain a pressure that is at least equal to the pressure prevailing inside the condenser. However, a pressure larger than the pressure prevailing behind the radial impeller is already sufficient. In specific embodiments, said pressure adjusts to a pressure that is halfway between the condenser pressure and the evaporator pressure. In addition, a vapor feed inlet is provided within the motor housing in order to feed pressure which is present within the motor to a motor gap located between the stator and the motor shaft. In addition, the motor is configured such that a further gap extends from the motor gap, located between the stator and the motor shaft, along the radial impeller up to the routing space.

In accordance with the invention, one thereby achieves that a relatively high pressure, which is higher than the mean value of the pressures prevailing within the evaporator and the condenser, and is advantageously equal to or higher than the condenser pressure, prevails within the motor housing, whereas a lower pressure prevails within the further gap which extends along the radial impeller to the routing space.

Said pressure, which is equal to the mean value of the pressures prevailing within the evaporator and the condenser, exists on account of the fact that the radial impeller generates, when the vapor from the evaporator is compressed, a high-pressure area in front of the radial impeller and a low-pressure or negative-pressure area behind the radial impeller. In particular, the pressure present in the high-pressure area in front of the radial impeller is still smaller than the high pressure present within the condenser, and the small pressure "behind" the radial impeller, as it were, is still smaller than the high pressure at the exit of the radial impeller. It is only at the exit of the routing space that the high condenser pressure prevails.

Said pressure gradient, which is "coupled to" the motor gap, ensures that working vapor is drawn into the condenser along the motor gap and the further gap from the motor housing via the vapor feed inlet. Even though said vapor is at or above the temperature level of the condenser working medium, said very fact is advantageous since in this manner, any condensation problems inside the motor and, in particular, inside the motor shaft, which would promote corrosion etc., are avoided.

Thus, in this aspect of the present invention, it is precisely not the coldest working liquid, namely that which is present inside the evaporator, that is used for convective shaft cooling. The cold vapor present within the evaporator is also not used. Instead, what is used for convective shaft cooling is the vapor which is present in the heat pump and is at the condenser temperature. Thus, sufficient shaft cooling is still achieved, specifically due to the convective nature, i.e. due to the fact that the motor shaft has a significant and, in particular, adjustable amount of vapor flowing around it due to the vapor feed inlet, the motor gap and the further gap. Since said vapor is relatively warm as compared to the vapor present within the evaporator, it is ensured at the same time that no condensation takes place along the motor shaft within the motor gap and/or the further gap. Instead, the temperature provided here is higher than the coldest temperature. Condensation will occur at the coldest temperature within a volume and will therefore not occur within the motor gap and the further gap since they actually have the warm vapor flowing around them.

Thus, the present invention results in sufficient convective shaft cooling. This prevents excessive temperatures from occurring within the motor shaft and, thus, associated signs of wear. In addition, condensation is effectively prevented from occurring within the motor, e.g. during standstill of the heat pump. Thus, any problems relating to operational safety and corrosion that would come with such condensation are also effectively eliminated. Consequently, in accordance with the aspect of convective shaft cooling, the present invention results in a significantly fail-safe heat pump.

In a further aspect of the present invention which relates to a heat pump comprising motor cooling, the heat pump includes a condenser comprising a condenser housing, a compressor motor mounted on the condenser housing and comprising a rotor and a stator. The rotor includes a motor shaft which has a compressor wheel for compressing working medium vapor mounted thereon. In addition, the compressor motor comprises a motor wall. The heat pump includes a motor housing which surrounds the compressor motor and is advantageously configured to maintain a pressure which is at least equal to the pressure present within the condenser, and which comprises a working-medium intake in order to direct liquid working medium from the condenser to the motor wall for the purpose cooling the motor. However, the pressure within the motor housing may also be lower here since heat dissipation from the motor housing takes place by means of boiling and/or vaporization. Thus, the heat energy present at the motor wall is dissipated from the motor wall mainly by means of the vapor, said heated vapor then being carried off, e.g., into the condenser. Alternatively, the vapor resulting from cooling of the motor may also be introduced into the evaporator or discharged to the outside, however. However, what is advantageous is for the heated vapor to be directed into the condenser. Unlike water cooling, wherein a motor is cooled by water flowing past it, in this aspect of the invention cooling takes place by means of evaporation, so that the heat energy to be transported off is discharged by the dissipation of vapor that is provided. One advantage is that less liquid is needed for cooling and that the vapor may be readily led off, e.g. may be automatically led into the condenser within which the vapor will then re-condense and will thus discharge the thermal output of the motor to the condenser liquid.

The motor housing is therefore configured to form, during operation of the heat pump, a vapor space wherein the working medium, which is present due to nucleate boiling or vaporization, is located. The motor housing further is configured to carry off the vapor from the vapor space within the motor housing by means of vapor discharge. Said discharge is advantageously performed into the condenser, so that vapor discharge is achieved by means of a gas-permeable connection between the condenser and the motor housing.

The motor housing is advantageously further configured to maintain, during operation of the heat pump, a maximum level of liquid working medium within the motor housing and to further form a vapor space above the maximum of the level. The motor housing is further configured to direct working medium that is above the maximum level into the condenser. Said implementation enables keeping cooling due to vapor generation very robust since the level of working liquid ensures that there will be enough working liquid for nucleate boiling at the motor wall. Alternatively, it is also possible to spray working liquid onto the motor wall instead of maintaining the level of working liquid. The liquid sprayed will then be metered such that it will evaporate upon contact with the motor wall and that cooling of the motor will thus be achieved.

Thus, the motor is effectively cooled, at its motor wall, with liquid working medium. Said liquid working medium, however, is not the cold working medium coming from the evaporator, but the warm working medium coming from the condenser. Using the warm working medium from the condenser nevertheless provides for sufficient motor cooling. However, at the same time it is ensured that the motor is not cooled off too much and, in particular, is not cooled to such an extent that it will be the coldest part within the condenser and/or on the condenser housing. If this were the case, this would result in that, e.g. during standstill of the motor, but also during operation, condensation of working medium vapor would take place on the outside of the motor housing, which would result in corrosion and further problems. Instead it is ensured that the motor is indeed cooled well while being the warmest part of the heat pump, to the effect that condensation, which takes place at the coldest "end", will not take place at the very compressor motor.

Advantageously, the liquid working medium within the motor housing is maintained at almost the same pressure that is exhibited by the condenser. This results in that the working medium, which cools the motor, is close to its boiling point since said working medium is a condenser working medium and is at a similar temperature as prevails inside the condenser. If the motor wall is heated during operation of the motor because of friction, the thermal energy is transferred to the liquid working medium. Due to the fact that the liquid working medium is close to its boiling point, nucleate boiling will now start within the motor housing, in the liquid working medium, which fills up the motor housing up to the maximum level.

Said nucleate boiling enables extraordinarily efficient cooling due to the intense intermixture of the volume of liquid working medium within the motor housing. Said boiling-supported cooling may further be significantly supported by a convection element that is advantageously provided, so that eventually, very efficient motor cooling is achieved by using a relatively small volume, or even no hold-up volume at all, of liquid working medium, which motor cooling additionally need not be controlled further since it is self-controlling. Thus, efficient motor cooling is achieved with little technical expenditure and in turn significantly contributes to operational safety of the heat pump.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
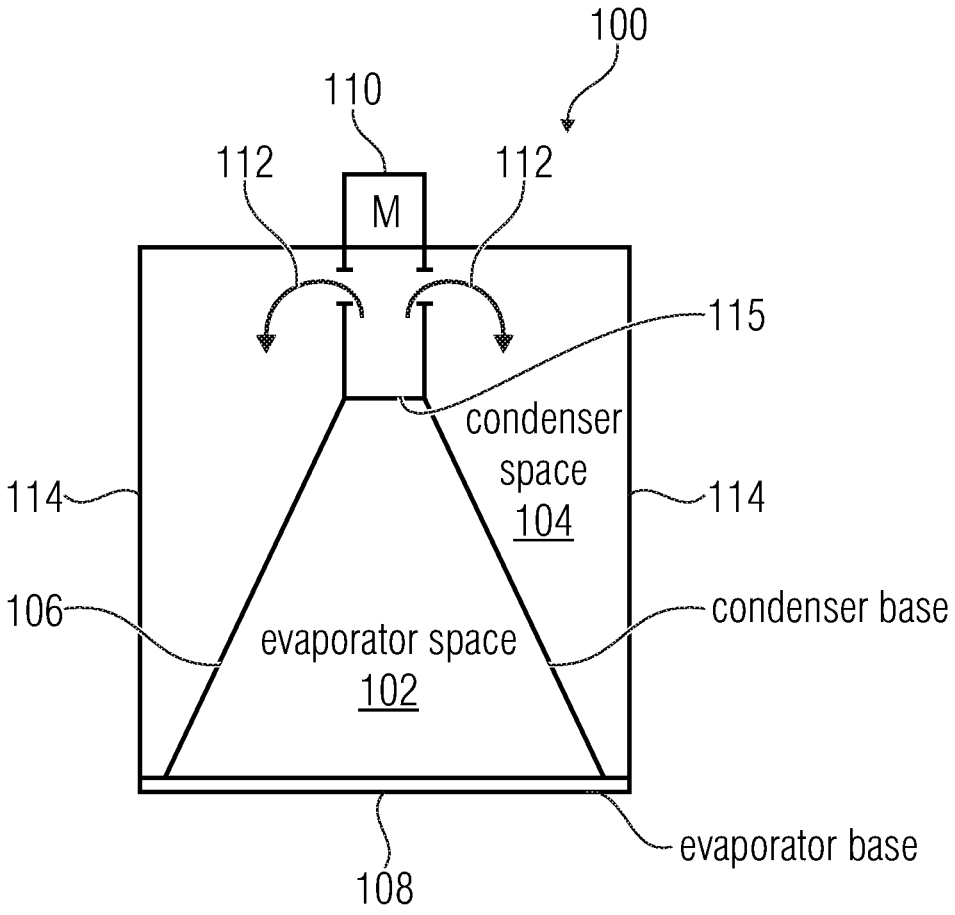
FIG. 1 shows a schematic view of a heat pump having an interleaved evaporator/condenser arrangement.

FIG. 1 shows a heat pump 100 comprising an evaporator for evaporating working liquid within an evaporator space 102. The heat pump further includes a condenser for condensing evaporated working liquid within a condenser space 104 bounded by a condenser base 106. As shown in FIG. 1, which can be regarded both as a sectional representation and as a side view, the evaporator space 102 is at least partially surrounded by the condenser space 104. Moreover, the evaporator space 102 is separated from the condenser space 104 by the condenser base 106. In addition, the condenser base is connected to an evaporator base 108 so as to define the evaporator space 102. In one implementation, a compressor 110 is provided above the evaporator space 102 or at a different location, said compressor 110 not being explained in detail in FIG. 1 but being configured, in principle, to compress evaporated working liquid and to direct same into the condenser space 104 as compressed vapor 112. Moreover, the condenser space is bounded toward the outside by a condenser wall 114. The condenser wall 114 is also attached to the evaporator base 108, as is the condenser base 106. In particular, the dimensioning of the condenser base 106 in the area forming the interface with the evaporator base 108 is such that in the embodiment shown in FIG. 1, the condenser base is fully surrounded by the condenser space wall 114. This means that the condenser space extends right up to the evaporator base, as shown in FIG. 1, and that the evaporator base simultaneously extends very far upward, typically almost through the entire condenser space 104.

This "interleaved" or intermeshing arrangement of the condenser and the evaporator, which arrangement is characterized in that the condenser base is connected to the evaporator base, provides a particularly high level of heat pump efficiency and therefore enables a particularly compact design of a heat pump. In terms of order of magnitude, dimensioning of the heat pump, e.g., in a cylindrical shape, is such that the condenser wall 114 represents a cylinder having a diameter of between 30 and 90 cm and a height of between 40 and 100 cm. However, the dimensioning can be selected as a function of the useful power class of the heat pump, but will advantageously range within the dimensions mentioned. Thus, a very compact design is achieved which additionally is easy to produce at low cost since the number of interfaces, in particular for the evaporator space subjected to almost a vacuum, can be readily reduced when the evaporator base in accordance with advantageous embodiments of the present invention is configured such that it includes all of the liquid feed inlets/discharge outlets and such that, as a result, no liquid feed inlets/discharge outlets from the side or from the top are required.

In addition, it shall be noted that the operating direction of the heat pump is as shown in FIG. 1. This means that during operation, the evaporator base defines the lower portion of the heat pump, however, apart from lines connecting it to other heat pumps or to corresponding pump units. This means that during operation, the vapor produced within the evaporator space rises upward and is redirected by the motor and is fed into the condenser space from top to bottom, and that the condenser liquid is directed from bottom to top and is then supplied to the condenser space from the top and then flows from top to bottom within the condenser space such as by means of individual droplets or by means of small liquid streams so as to react with the compressed vapor, which advantageously is supplied in a transverse direction, for the purposes of condensation.

This arrangement, which is mutually "interleaved" in that the evaporator is almost entirely or even entirely arranged within the condenser, enables very efficient implementation of the heat pump with optimum space utilization. Since the condenser space extends right up to the evaporator base, the condenser space is configured within the entire "height" of the heat pump or at least within a major portion of the heat pump. At the same time, however, the evaporator space is as large as possible since it also extends almost over the entire height of the heat pump. Due to the mutually interleaved arrangement in contrast to an arrangement where the evaporator is arranged below the condenser, the space is exploited in an optimum manner. This enables particularly efficient operation of the heat pump, on the one hand, and a particularly space-saving and compact design, on the other hand, since both the evaporator and the condenser extend over the entire height. Thus, admittedly, the levels of "thickness" of the evaporator space and of the condenser space decrease. However, one has found that the reduction of the "thickness" of the evaporator space, which tapers within the condenser, is unproblematic since the major part of the evaporation takes place in the lower region, where the evaporator space fills up almost the entire volume available. On the other hand, the reduction of the thickness of the condenser space is uncritical particularly in the lower region, i.e., where the evaporator space fills up almost the entire region available since the major part of the condensation takes place at the top, i.e., where the evaporator space is already relatively thin and thus leaves sufficient space for the condenser space. The mutually interleaved arrangement is thus ideal in that each functional space is provided with the large volume where said functional space involves said large volume. The evaporator space has the large volume at the bottom, whereas the condenser space has the large volume at the top. Nevertheless, that corresponding small volume which for the respective functional space remains where the other functional space has the large volume contributes to an increase in efficiency as compared to a heat pump where the two functional elements are arranged one above the other, as is the case, e.g., in WO 2014072239 A1.

In advantageous embodiments, the compressor is arranged on the upper side of the condenser space such that the compressed vapor is redirected by the compressor, on the one hand, and is simultaneously fed into a marginal gap of the condenser space. Thus, condensation with a particularly high level of efficiency is achieved since a cross-flow direction of the vapor in relation to a condensation liquid flowing downward is achieved. This condensation comprising cross-flow is effective particularly in the upper region, where the evaporator space is large, and does not require a particularly large region in the lower region where the condenser space is small to the benefit of the evaporator space, in order to nevertheless allow condensation of vapor particles that have reached said region.

An evaporator base connected to the condenser base is advantageously configured such that it accommodates within it the condenser intake and drain, and the evaporator intake and drain, it being possible, additionally, for certain passages for sensors to be present within the evaporator and/or within the condenser. In this manner, one achieves that no passages of conduits through the evaporator are required for the capacitor intake and drain, which is almost under a vacuum. As a result, the entire heat pump becomes less prone to defects since each passage through the evaporator would present a possibility of a leak. To this end, the condenser base is provided with a respective recess in those positions where the condenser intakes and drains are located, to the effect that no condenser feed inlets/discharge outlets extend within the evaporator space defined by the condenser base.

The condenser space is bounded by a condenser wall, which can also be mounted on the evaporator base. Thus, the evaporator base has an interface both for the condenser wall and for the condenser base and additionally has all of the liquid feed inlets both for the evaporator and for the condenser.

In specific implementations, the evaporator base is configured to comprise connection pipes for the individual feed inlets, which have cross-sections differing from a cross-section of the opening on the other side of the evaporator base. The shape of the individual connection pipes is then configured such that the shape, or cross-sectional shape, changes across the length of the connection pipe, but the pipe diameter, which plays a part in the flow rate, is almost identical with a tolerance of ±10%. In this manner, water flowing through the connection pipe is prevented from starting to cavitate. Thus, on account of the good flow conditions obtained by the shaping of the connection pipes, it is ensured that the corresponding pipes/lines can be made to be as short as possible, which in turn contributes to a compact design of the entire heat pump.

In a specific implementation of the evaporator base, the condenser intake is split up into a two-part or multi-part stream, almost in the shape of "eyeglasses". Thus, it is possible to feed in the condenser liquid in the condenser at its upper portion at two or more locations at the same time. Thus, a strong and, at the same time, particularly even condenser flow from top to bottom is achieved which enables achieving highly efficient condensation of the vapor which is introduced into the condenser from the top as well.

A further feed inlet, having smaller dimensions, within the evaporator base for condenser water may also be provided in order to connect a hose therewith which feeds cooling liquid to the compressor motor of the heat pump; what is used to achieve cooling is not the cold liquid which is supplied to the evaporator but the warmer liquid which is supplied to the condenser but which in typical operational situations is still cool enough for cooling the motor of the heat pump.

The evaporator base is characterized in that it exhibits combined functionality. On the one hand, it is ensures that no condenser feed inlets need to be passed through the evaporator, which is under very low pressure. On the other hand, it represents an interface toward the outside, which advantageously has a circular shape since in the case of a circular shape, a maximum amount of evaporator surface area remains. All of the feed inlets/discharge outlets lead through the one evaporator base and from there extend either into the evaporator space or into the condenser space. It is particularly advantageous to manufacture the evaporator base from plastics injection molding since the advantageous, relatively complicated shapes of the intake/drain pipes can be readily implemented in plastics injection molding at low cost. On the Other hand, it is readily possible, due to the implementation of the evaporator base as an easily accessible workpiece, to manufacture the evaporator base with sufficient structural stability so that it can readily withstand in particular the low evaporator pressure.

In the present application, identical reference numerals relate to elements which are identical or identical in function; however, not all of the reference numerals will be repeated in all of the drawings if they come up more than once.

Figure 2:
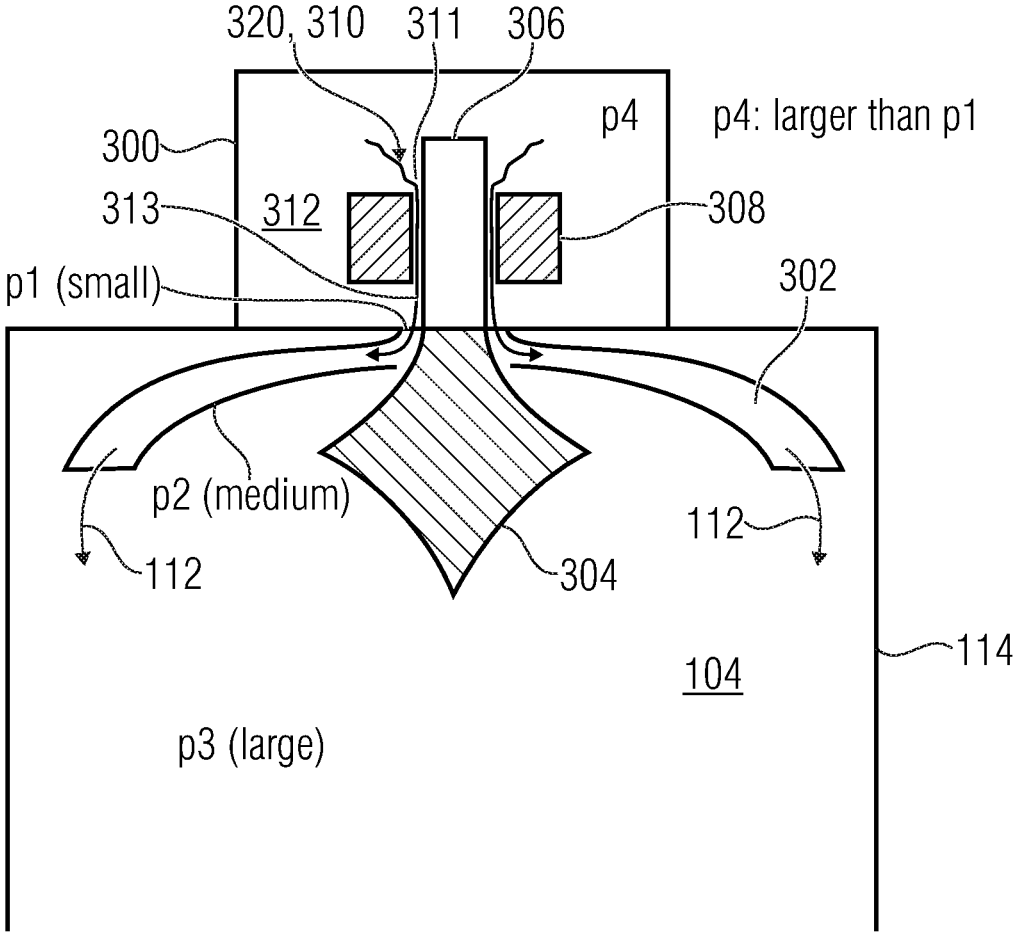
FIG. 2 shows a schematic representation of a heat pump having convective shaft cooling in accordance with one aspect.
Figure 4:
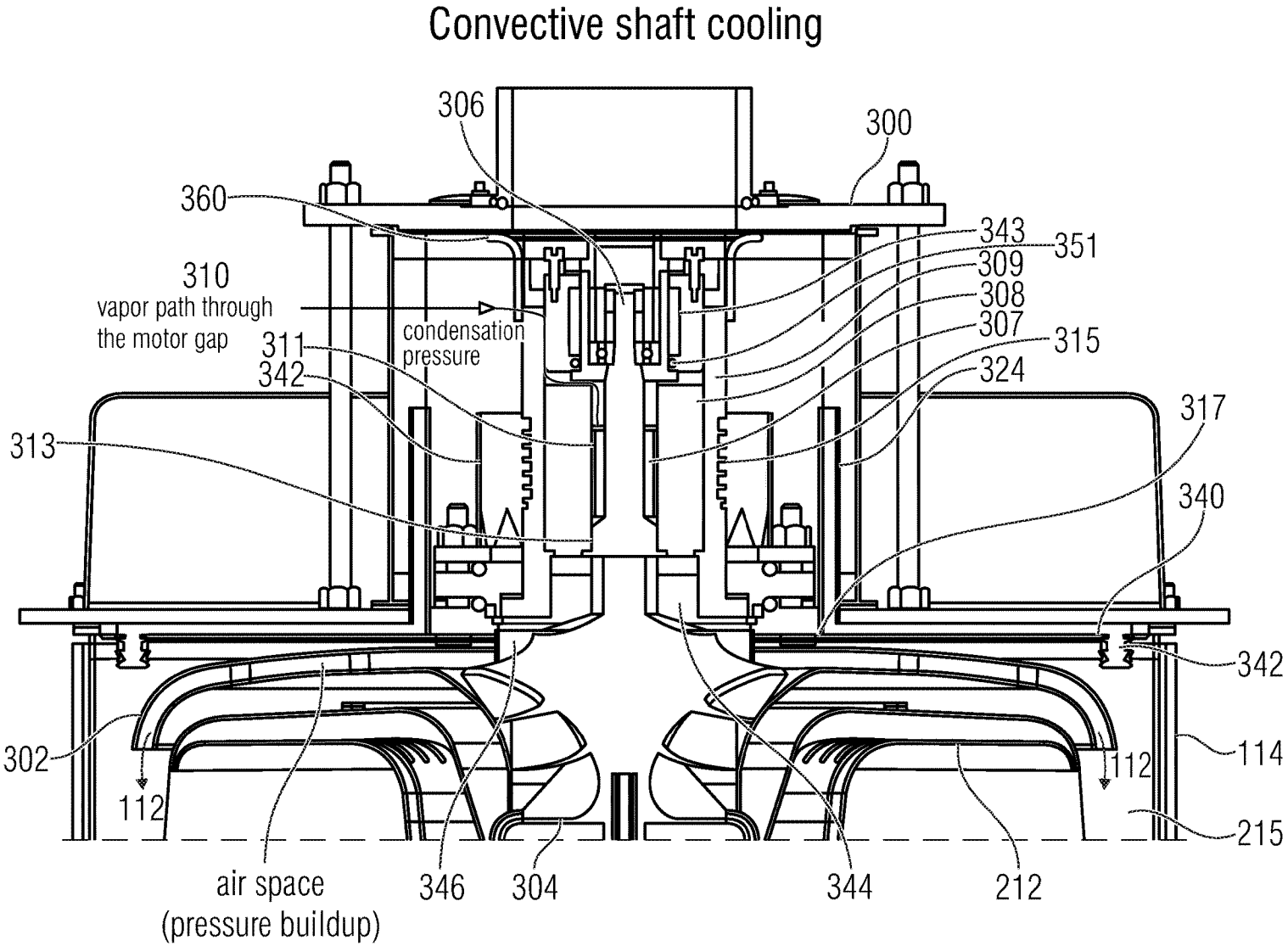
FIG. 4 shows a sectional representation of a heat pump in accordance with an embodiment, comprising convective shaft cooling, on the one hand, and motor cooling, on the other hand, while specifically taking into account convective shaft cooling.

FIG. 2 shows a heat pump in accordance with an embodiment in connection with the first aspect, i.e. convective shaft cooling. For example, the heat pump of FIG. 2 includes a condenser comprising a condenser housing 114 including a condenser space 104. Moreover, the compressor motor, which is schematically depicted by the stator 308 in FIG. 4 is mounted. Said compressor motor is mounted on the condenser housing 114 in a manner not shown in FIG. 2 and includes the stator and a rotor 306, the rotor 306 comprising a motor shaft having a radial impeller 304 mounted thereon which extends into an evaporator zone not shown in FIG. 2. In addition, the heat pump includes a routing space 302 configured to receive vapor that is compressed by the radial impeller and to route same into the condenser, as is schematically depicted at 112.

In addition, the motor includes a motor housing 300 which surrounds the compressor motor and is advantageously configured to maintain a pressure that is at least equal to the pressure present within the condenser. Alternatively, the motor housing is configured to maintain a pressure that is higher than a mean value of the pressures prevailing within the evaporator and the condenser or which is higher than the pressure present within the further gap 313 located between the radial impeller and the routing space (302), or which is larger than or equal to the pressure present within the condenser. The motor housing thus is configured such that a pressure drop takes place from the motor housing along the motor shaft in the direction of the routing space, by which the working vapor is drawn past the motor shaft through the motor gap and the further gap so as to cool the shaft.

Said area within the motor housing which comprises the pressure that may be used is depicted at 312 in FIG. 2. In addition, a vapor feed inlet 310 is configured to feed vapor present within the motor housing 300 to a motor gap 311 located between the stator 308 and the shaft 306. Moreover, the motor includes a further gap 313 extending from the motor gap 311 along the radial impeller toward the routing space 302.

In the inventive arrangement, a relatively large pressure $p_3$ prevails within the condenser. By contrast, a medium pressure $p_2$ prevails within the routing path or routing space 302. The smallest pressure is present, apart from the evaporator, behind the radial impeller, specifically where the radial impeller is fixed to the motor shaft, i.e. within the further gap 313. The motor housing 300 has a pressure $p_4$ therein which is equal to or larger than the pressure $p_3$. This results in a pressure drop from the motor housing to the end of the further gap. This pressure gradient results in that a flow of vapor takes place through the vapor feed inlet and into the motor gap and the further gap up to the routing path 302. Said flow of vapor takes working vapor from the motor housing along past the motor shaft and into the condenser. Said flow of vapor ensures convective shaft cooling of the motor shaft through the motor gap 311 and the further gap 313, which is adjacent to the motor gap 311. I.e., the radial impeller sucks off vapor in the downward direction, past the shaft of the motor. Said vapor is drawn into the motor gap via the vapor feed inlet, which is typically implemented as specifically implemented bores.

Figure 3:
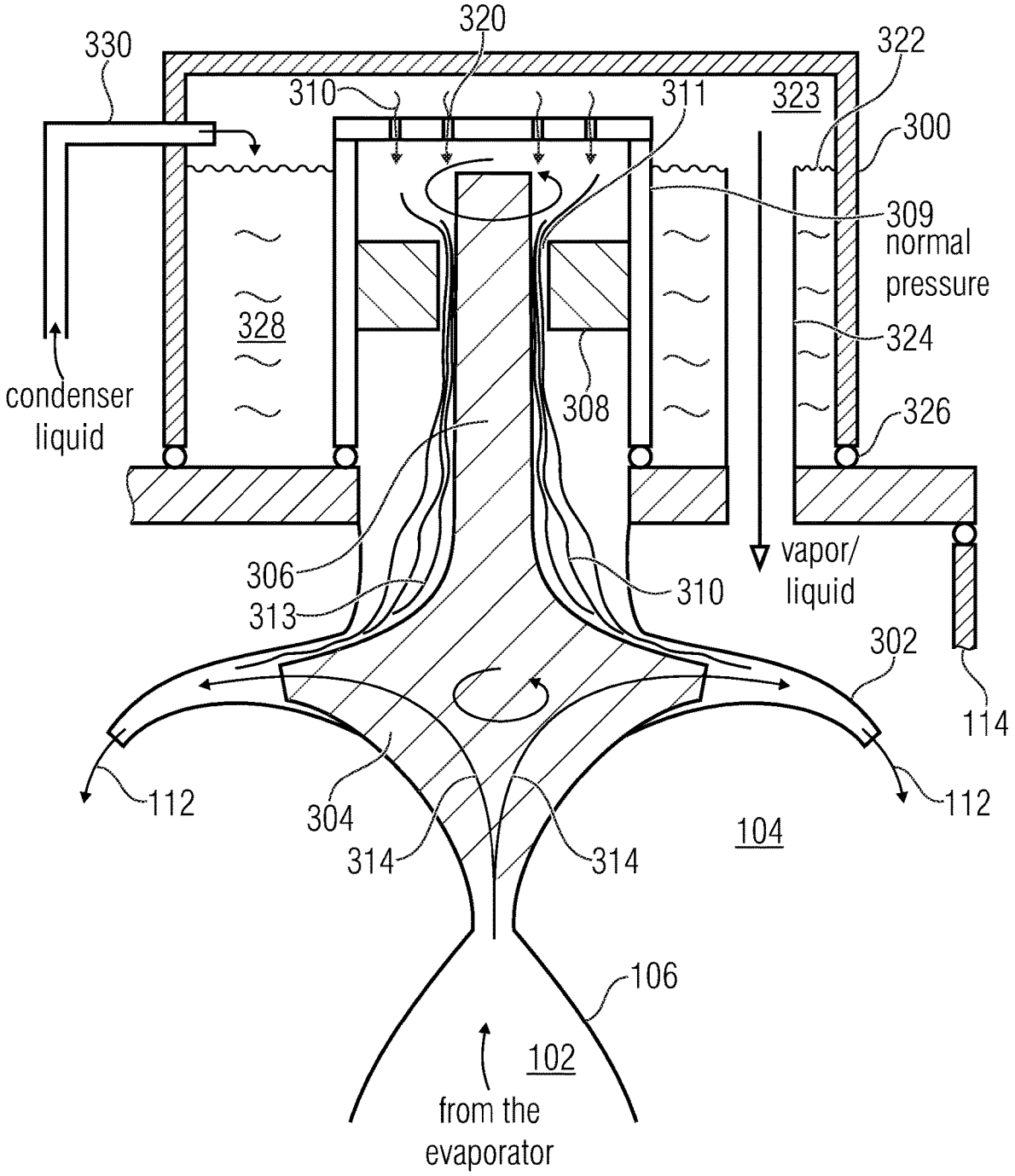
FIG. 3 shows a schematic representation of a heat pump having convective shaft cooling, on the one hand, and motor cooling in accordance with a further aspect, on the other hand.

FIG. 3 shows a further schematic implementation of convective shaft cooling in accordance with the first aspect of the present invention, which there is advantageously combined with motor cooling in accordance with the second aspect of the present invention.

However, it shall be generally noted at this point that both aspects—convective shaft cooling on the one hand, and motor cooling, on the other hand—are also employed separately from each other. For example, motor cooling without any specific separate convective shaft cooling already results in a considerable increase in operational safety. In addition, convective motor shaft cooling without additional motor cooling also results in an increase in the operational safety of the heat pump. However, as will be depicted in FIG. 3 below, both aspects may be combined in a particularly favorable manner so as to implement, with a particularly advantageous design of the motor housing and of the compressor motor, both convective shaft cooling and motor cooling, which may be additionally supplemented, in a further advantageous embodiment, by specific ball-bearing cooling individually or jointly.

FIG. 3 shows an embodiment comprising combined utilization of convective shaft cooling and motor cooling; in the embodiment shown in FIG. 3, the evaporator zone is shown to be at 102. The evaporator zone is separated from the condenser zone, i.e. from the condensation area 104, by the condenser base 106. Working vapor, which is schematically depicted at 314, is sucked in by means of the rotating radial impeller 304, which is depicted schematically and in section, and is "pressed" into the routing path 302. In the embodiment shown in FIG. 3, the routing path 302 is configured such that its cross section increases toward the outside. Thus, further vapor compression takes place. The first "stage" of vapor compression already takes place because of the rotation of the radial impeller and because of the vapor being "sucked in" by means of the radial impeller. However, when the radial impeller feeds the vapor into the entrance of the routing path, i.e. where the radial impeller "stops" when viewed in the upward direction, the vapor which has already been pre-compressed comes across a vapor buildup, as it were, which is present due to the tapering of the routing path and also due to the curvature of the routing path. This results in further vapor compression, so that eventually, the compressed and, thus, heated vapor 112 flows into the condenser.

FIG. 3 further shows the vapor feed openings 320 configured in a schematically depicted motor wall 309 in FIG. 3. Said motor wall 309 comprises, in the embodiment shown in FIG. 3, bores for the vapor feed openings 320 in the upper area, which bores may be configured at any locations, however, where vapor may enter into the motor gap 311 and, thus, also into the further motor gap 313. The vapor flow 310 caused thereby results in the desired effect of convective shaft cooling.

The embodiment shown in FIG. 3 further includes, to implement motor cooling, a working medium intake 330 configured to direct liquid working medium from the condenser to the motor wall for the purpose of cooling the motor. In addition, the motor housing is configured to maintain, during operation of the heat pump, a maximum liquid level 322 of liquid working medium. Moreover, the motor housing 300 is also configured to form a vapor space 323 above the maximum level. In addition, the motor housing provides measures for directing liquid working medium that is above the maximum level into the condenser 104. Said implementation is configured, in the embodiment shown in FIG. 3, by a channel-shaped overflow 324 which is configured to be flat, for example, forms the vapor discharge outlet and is arranged somewhere in the upper condenser wall and has a length defining the maximum level 322. If too much working liquid is introduced into the motor housing, i.e. the liquid area 328, through the condenser liquid feed inlet 330, the liquid working medium will flow through the overflow 324 and into the condenser volume. Moreover, even in the passive arrangement shown in FIG. 3, which may alternatively also be a small pipe, for example, of a corresponding length, the overflow establishes pressure equalization between the motor housing and, in particular, the vapor space 323 of the motor housing and the interior of the condenser 104. Thus, the pressure within the vapor space 323 of the motor housing is almost equal to or, at the most, slightly higher, due to a pressure loss along the overflow, than the pressure inside the condenser. Thus, the boiling point of the liquid 328 within the motor housing will be similar to the boiling point within the condenser housing. Consequently, heating of the motor wall 309 due to dissipation power generated within the motor results in that nucleate boiling, which will be discussed later, takes place within the liquid volume 328.

FIG. 3 further shows various sealings in schematic forms at reference numeral 326 and at similar locations between the motor housing and the condenser housing, on the one hand, but also between the motor wall 309 and the condenser housing 114, on the other hand. Said scalings are to symbolize that the connection here is to be liquid- and pressure-tight.

The motor housing is defined as a separate space, which represents a pressure zone almost equal to that of the condenser, however. Due to heating of the motor and due to the energy thus output at the motor wall 309, this supports nucleate boiling within the liquid volume 328, which in turn results in particularly efficient distribution of the working medium within the volume 328 and, thus, in particularly good cooling with a small volume of cooling liquid. In addition, it is ensured that cooling takes place by means of that working medium that is at the most favorable temperature, namely the warmest temperature within the heat pump. Thus, it is ensured that any condensation problems which occur on cold surfaces are eliminated both for the motor wall and for the motor shaft and for the areas within the motor gap 311 and the further gap 313. Furthermore, in the embodiment shown in FIG. 3, the working medium vapor 310 used for convective shaft cooling is vapor which otherwise is present within the vapor space 323 of the motor housing. Just like the liquid 328, said vapor also has the optimum (warm) temperature. In addition, it is ensured by means of the overflow 324 that the pressure present within the area 323 cannot exceed the condenser pressure on the ground of the nucleate boiling caused by the motor cooling and/or the motor wall 309. In addition, because of the discharge of vapor, the thermal energy is discharged on the grounds of the motor being cooled. Consequently, convective shaft cooling will typically operate in the same manner. Specifically, if the increase in pressure were too pronounced, too much working medium vapor might be pressed through the motor gap 311 and the further gap 313.

The bores 320 for vapor feed will typically be configured in an array which may be arranged in a regular or irregular manner. In terms of diameter, the individual bores do not exceed 5 mm and may have a minimum size of 1 mm.

Figure 6:
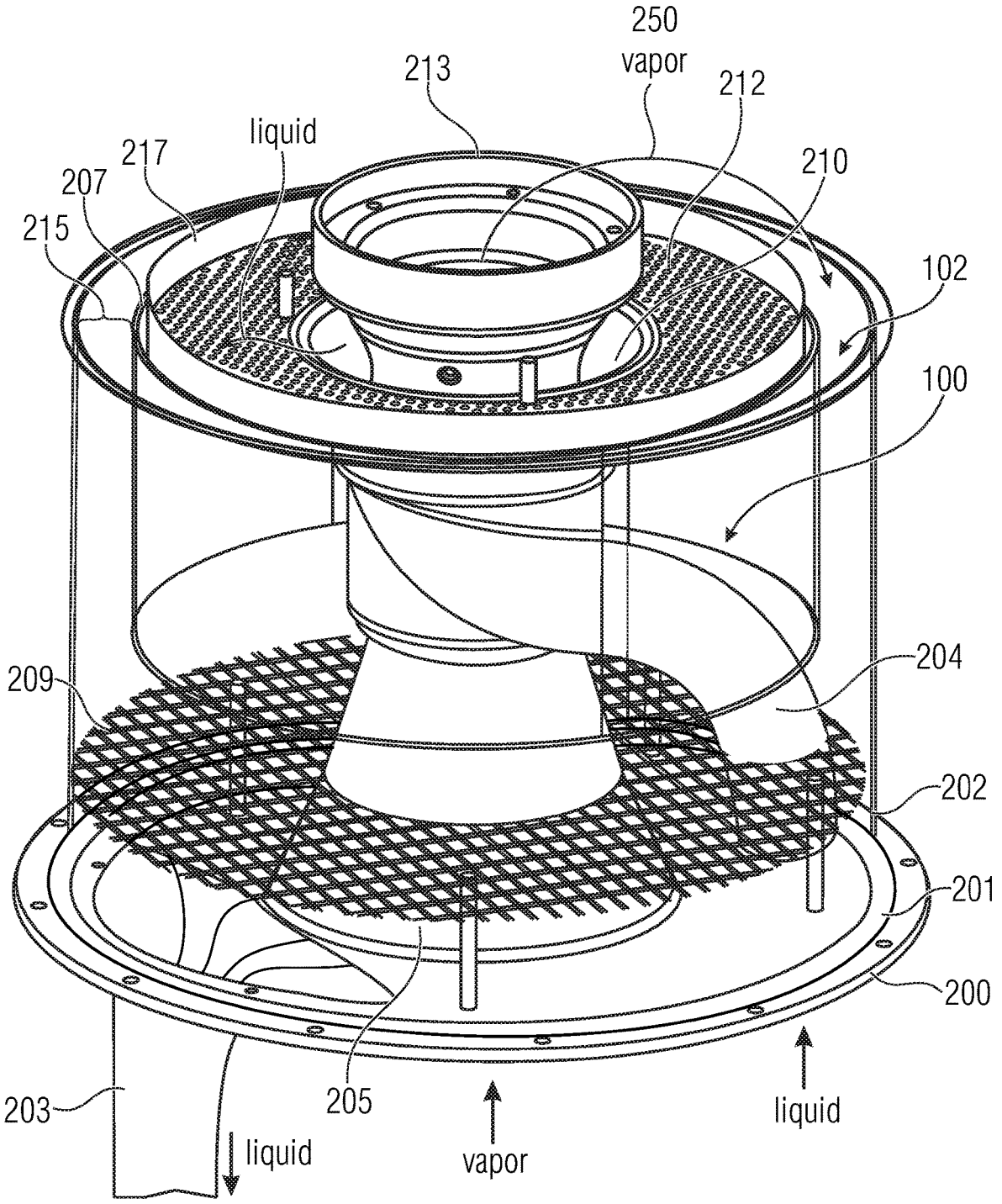
FIG 6 (PRIOR ART)
FIG. 6 shows a perspective representation of a condenser as shown in WO 2014072239 A1.

FIG. 6 shows a condenser, the condenser in FIG. 6 comprising a vapor introduction zone 102 extending completely around the condensation zone 100. In particular, FIG. 6 shows a part of a condenser which comprises a condenser base 200. The condenser base has a condenser housing portion 202 arranged thereon which is drawn to be transparent in the representation of FIG. 6 but in reality need not necessarily be transparent but may be formed from plastic, die-cast aluminum or the like. The lateral housing part 202 rests upon a rubber seal 201 so as to achieve good sealing with the base 200. Moreover, the condenser includes a liquid drain 203 and a liquid intake 204 as well as a vapor feed inlet 205 centrally arranged within the condenser and tapering from bottom to top in FIG. 6. It shall be noted that FIG. 6 represents the actually desired installation direction of a heat pump and of a condenser of said heat pump; in this installation direction in FIG. 6, the evaporator of a heat pump is arranged below the condenser. The condensation zone 100 is bounded toward the outside by a basket-like boundary object 207, which just like the outer housing part 202 is drawn to be transparent and is normally configured in a basket-like manner.

Moreover, a grid 209 is arranged which is configured to support fillers not shown in FIG. 6. As can be seen from FIG. 6, the basket 207 extends downward to a certain point only. The basket 207 is provided to be permeable to vapor so as to obtain fillers such as so called Pall rings, for example. Said fillers are introduced into the condensation zone, but only within the basket 207 and not within the vapor introduction zone 102. The fillers, however, are filled in to such a level, even outside the basket 207, that the height of the fillers extends either to the lower boundary of the basket 207 or slightly beyond.

The condenser of FIG. 6 includes a working liquid feeder which is formed—in particular by the working liquid feed inlet 204 which, as shown in FIG. 6, is arranged to be wound around the vapor feed inlet in the form of an ascending turn—by a liquid transport region 210 and by a liquid distributor element 212 which is advantageously configured as a perforated plate. In particular, the working liquid feeder is thus configured to feed the working liquid into the condensation zone.

In addition, a vapor feeder is also provided which, as shown in FIG. 6, is advantageously composed of the feeding region 205, which tapers in a funnel-shaped manner, and the upper vapor guiding region 213. Within the vapor guiding region 213, a wheel of a radial compressor is advantageously employed, and the radial compression results in that vapor is sucked from the bottom upward through the feed inlet 205 and is then redirected, on account of the radial compression, by the radial impeller (radial wheel) by 90 degrees to the outside, as it were, i.e. from flowing bottom-up to flowing from the center to the outside in FIG. 6 with regard to the element 213.

What is not shown in FIG. 6 is a further redirecting unit, which redirects the vapor that has already been redirected toward the outside by another 90 degrees so as to then direct it from above into the gap 215 which represents the beginning of the vapor introduction zone, as it were, which extends laterally around the condensation zone. The vapor feeder is therefore advantageously configured to be ring-shaped and provided with a ring-shaped gap for feeding the vapor to the condensed, the working liquid feed inlet being configured within the ring-shaped gap.

Figure 7:
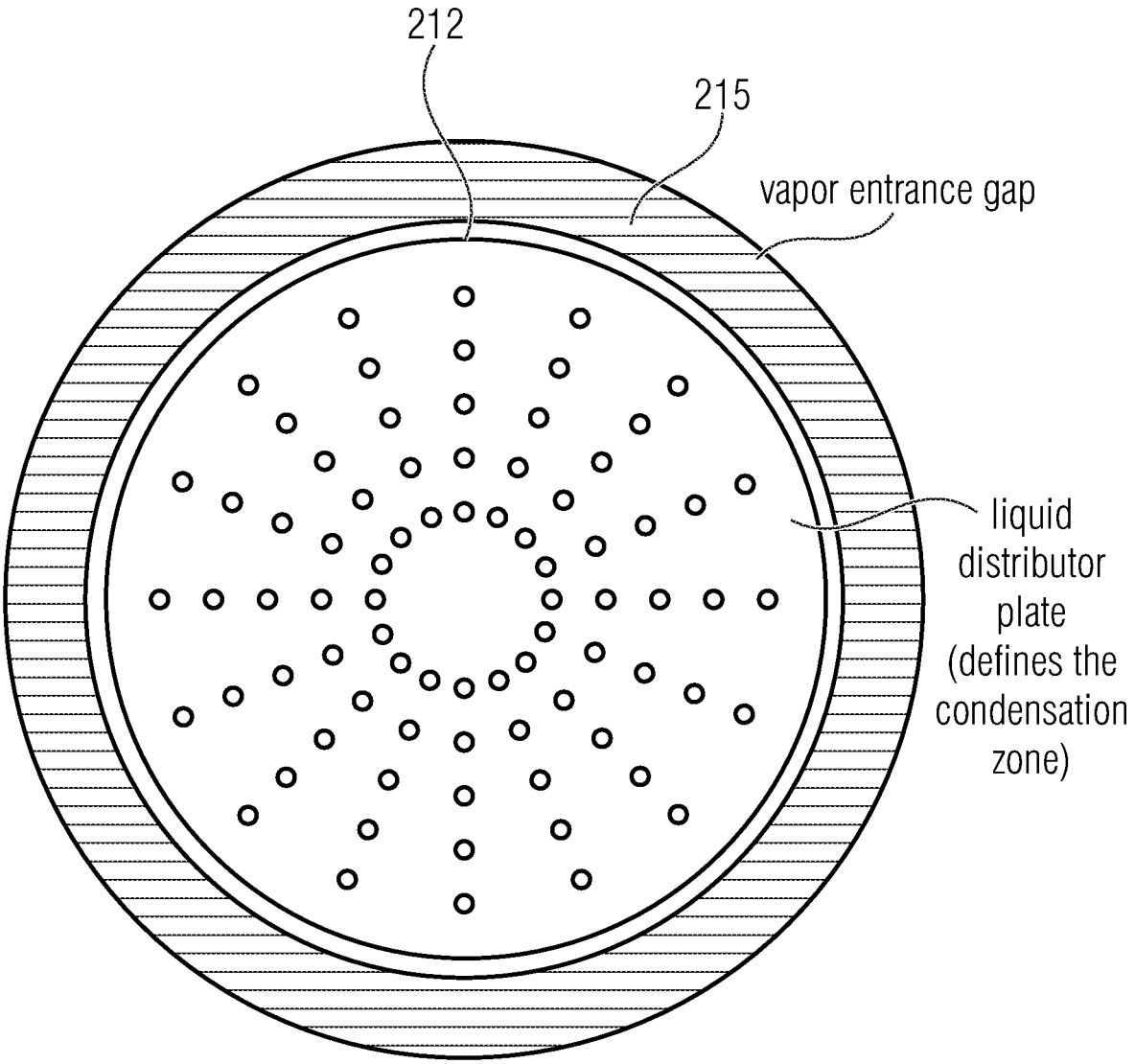
FIG 7 (PRIOR ART)
FIG. 7 shows a representation of the liquid distributor plate, on the one hand, and of the vapor entrance zone with a vapor entrance gap, on the other hand, from WO 2014072239 A1.
Figures 8A, 8B:
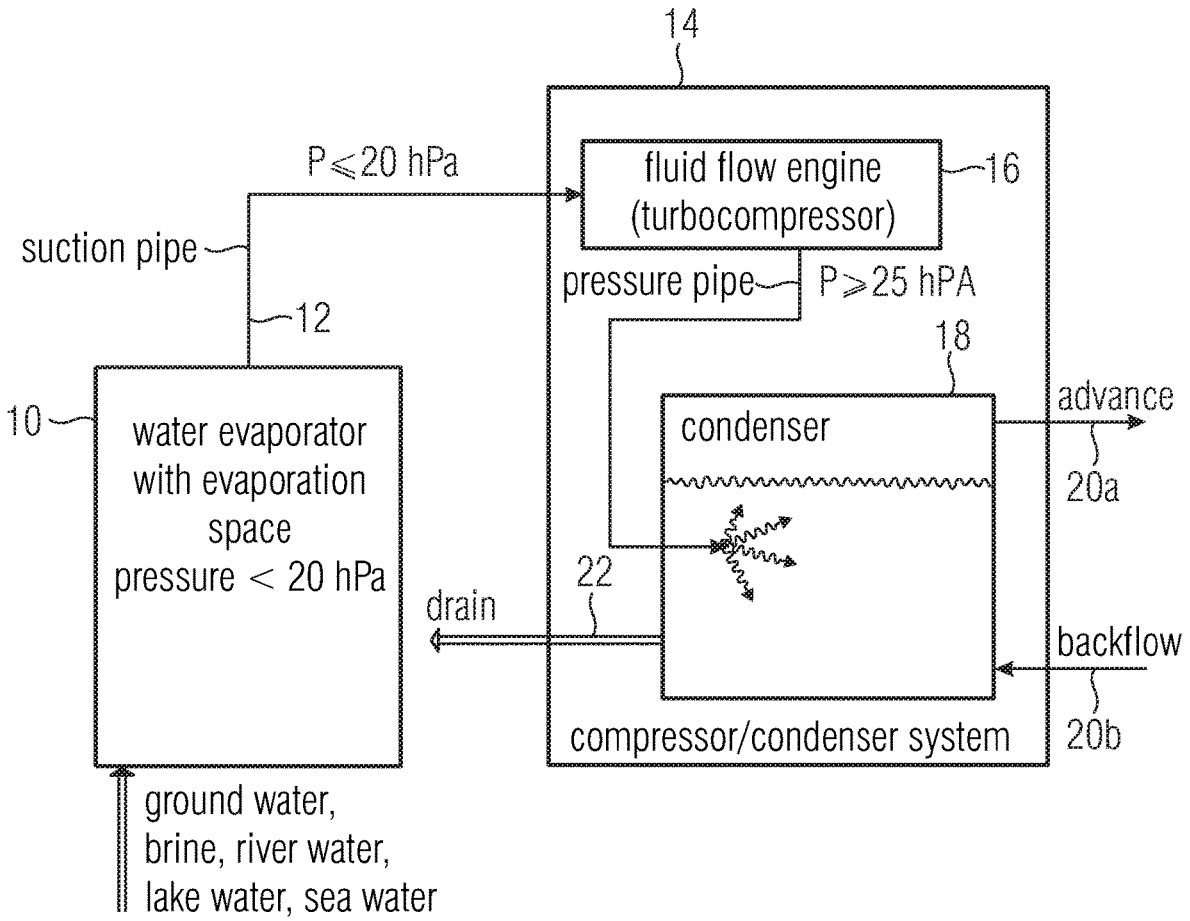
FIG 8A (PRIOR ART)
FIG. 8A shows a schematic representation of a known heat pump for evaporating water.
FIG. 8B shows a table for illustrating pressures and evaporation temperatures of water as a working liquid.

Please refer to FIG. 7 for illustration purposes. FIG. 7 shows a view of the "lid region" of the condenser of FIG. 6 from below. In particular, the perforated plate 212 which acts as a liquid distributor element is schematically depicted from below. The vapor entrance gap 215 is drawn schematically, and FIG. 7 shows that the vapor introduction gap is configured to be merely ring-shaped, such that vapor to be condensed is fed into the condensation zone neither directly from above nor directly from below, but is fed in from the sides all around only. Thus, only liquid, but no vapor, will flow through the holes of the distributor plate 212. The vapor is "sucked into" the condensation zone only from the sides, namely because of the liquid that has passed through the perforated plate 212. The liquid distributor plate may be formed from metal, plastic or a similar material and can be implemented with different hole patterns. As shown in FIG. 6, what is advantageously also to be provided is a lateral boundary for liquid flowing out of the element 210, said lateral boundary being designated by 217. In this manner it is ensured that liquid which exits the element 210 already with an angular momentum due to the curved feed inlet 204 and is distributed on the liquid distributor from the inside toward the outside will not splash over the edge into the vapor introduction zone, provided that the liquid has not previously dropped through the holes of the liquid distributor plate and has condensed with vapor.

Figure 5:
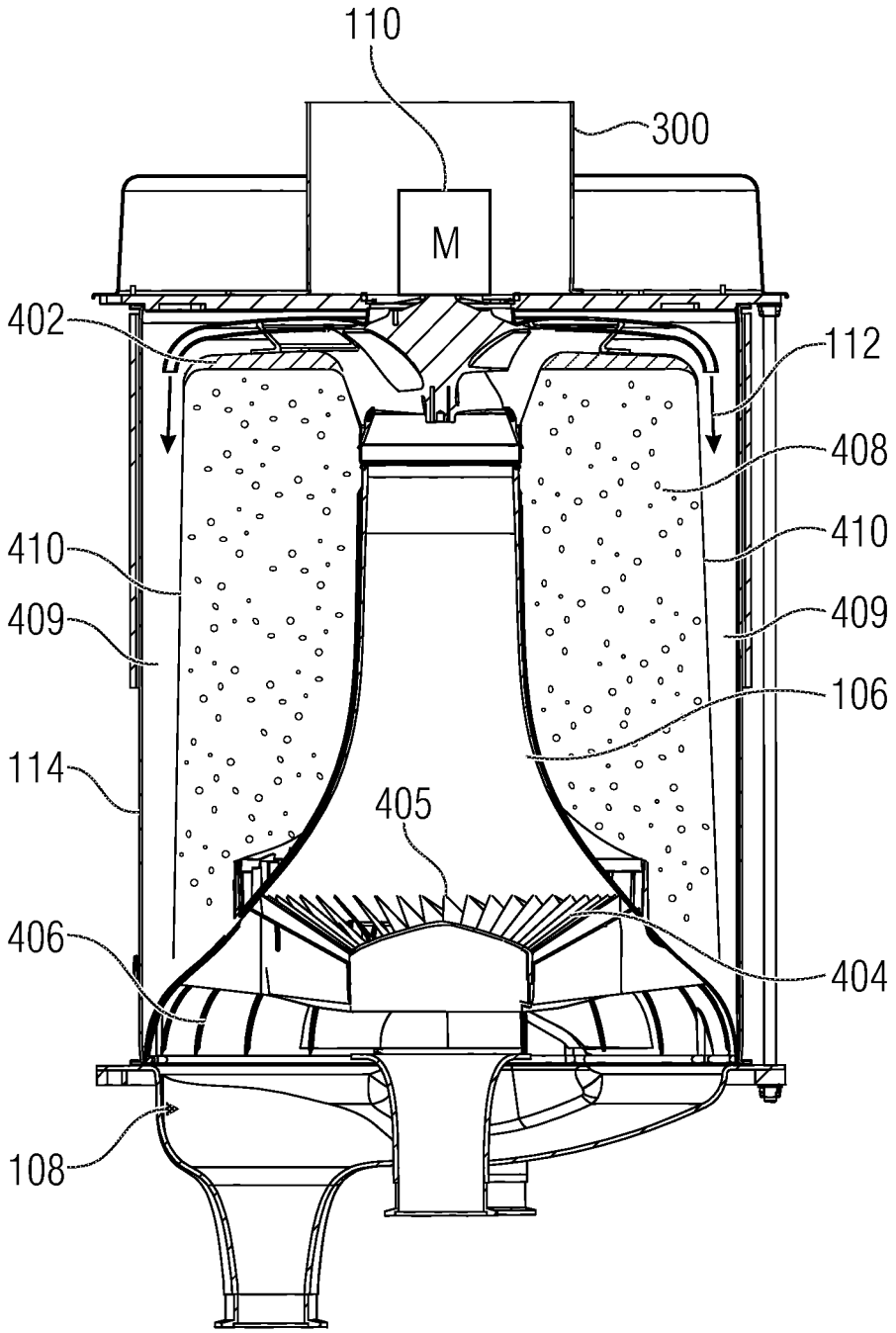
FIG. 5 shows a sectional view of a heat pump comprising an evaporator base and a condenser base in accordance with the embodiment of FIG. 1.

FIG. 5 shows a complete heat pump in a sectional representation including both the evaporator base 108 and the condenser base 106. As shown in FIG. 5 or also in FIG. 1, the condenser base 106 has a cross-section tapering from an intake for the working liquid to be evaporated to an exhaust opening 115 coupled to the compressor, or motor, 110, i.e., where the advantageously used radial impeller of the motor exhausts the vapor generated within the evaporator space 102.

FIG. 5 shows a cross-section through the entire heat pump. What is shown, in particular, is that a droplet separator 404 is arranged within the condenser base. Said droplet separator includes individual blades 405. So that the droplet separator remains in its position, said blades are inserted into corresponding grooves 406 which are shown in FIG. 5. Said grooves are arranged, within the condenser base, in a region pointing toward the evaporator base, on the inside of the evaporator base. In addition, the condenser base further has various guiding features which can be configured as small rods or tongues for holding hoses provided, e.g., for a condenser water guidance, i.e., which are placed onto corresponding portions and which couple the feeding points of the condenser water feed inlet. Said condenser water feed inlet 402 may be configured, depending on the implementation, such as is shown at reference numerals 102, 207 to 250 in FIGS. 6 and 7. In addition, the condenser advantageously has condenser liquid distribution means comprising two or more feeding points. A first feeding point is therefore connected to a first portion of a condenser intake. A second feeding point is connected to a second portion of the condenser intake. Should there be more feeding points for the condenser liquid distribution means, the condenser intake will be split up into further portions.

The upper region of the heat pump of FIG. 5 may thus be configured just like the upper region in FIG. 6, to the effect that feeding of the condenser water takes place via the perforated plate of FIG. 6 and FIG. 7, so that condenser water 408 trickling down is obtained into which the working vapor 112 is introduced advantageously in a lateral manner, so that cross-flow condensation, which allows a particularly high level of efficiency, can be obtained. As also depicted in FIG. 6, the condensation zone may be provided with a merely optional filling wherein the edge 207, which is also designated by 409, remains free from fillers or the like, to the effect that the working vapor 112 can still laterally enter into the condensation zone not only at the top, but also at the bottom. The imaginary boundary line 410 is to illustrate this in FIG. 5. However, in the embodiment shown in FIG. 5, the entire area of the condenser is configured with a condenser base 200 of its own, which is arranged above an evaporator base.

FIG. 4 shows a advantageous embodiment of a heat pump and, in particular, of a heat pump portion which shows the "upper" area of the heat pump as, depicted in FIG. 5, for example. In particular, the motor M 110 of FIG. 5 corresponds to the area which is surrounded by a motor wall 309, the outside of which is advantageously configured, in the cross-sectional representation in FIG. 4, within the liquid area 328, with cooling ribs so as to enlarge the surface of the motor wall 309. Moreover, the area of the motor housing 300 in FIG. 4 corresponds to the respective area 300 in FIG. 5. FIG. 4 further depicts the radial impeller 304 in a detailed cross section. The radial impeller 304 is mounted on the motor shaft 306 in an attachment area which is fork-shaped in cross section. The motor shaft 306 has a rotor 307 located opposite the stator 308. The rotor 307 includes permanent magnets schematically depicted in FIG. 4. In particular, the vapor path 310 is defined by the motor gap 311. The motor gap 311 extends between the rotor and the stator and leads into the further gap 313, which extends along the attachment area, which is fork-shaped in cross section, of the shaft 306 up to the routing space 302, as is also depicted at 346.

In addition, FIG. 4 depicts an emergency bearing 344 which during normal operation does not support the shaft. Instead, the shaft is supported by the bearing portion shown at 343. The emergency bearing 344 is present only to support the shaft and, thus, the radial impeller in the event of damage so that the quickly rotating radial impeller cannot cause, in the event of a damage, an even greater damage in the heat pump. FIG. 4 further shows various attachment elements such as screws, nuts, etc., and various sealings in the form of various O-rings. Moreover, FIG. 4 shows an additional convection element 342, which will be addressed later with reference to FIG. 10.

FIG. 4 further shows a splash guard 360 within the vapor space above the maximum volume within the motor housing, which is normally filled with liquid working medium. Said splash guard is configured to catch any drops of liquid which are hurled into the vapor space upon nucleate boiling. The vapor path 310 as schematically depicted in FIG. 4 is advantageously configured to benefit from the splash guard 360, i.e. is configured such that due to the flow being directed into the motor gap and the further gap, merely working medium vapor, but not drops of liquid, are sucked in on account of the boiling taking place within the motor housing.

The heat pump comprising convective shaft cooling advantageously has a vapor feed inlet configured such that a vapor flow through the motor gap and the further gap does not penetrate through a bearing portion configured to support the motor shaft in relation to the stator. This is indicated in FIG. 4. The bearing portion 343, which in the present case includes two ball bearings, is sealed off from the motor gap, specifically by O-rings 351, for example. Thus, as is shown by means of the path 310 in FIG. 4, the working vapor may enter, though the vapor feed inlet, merely into an area within the motor wall 309, may move downward from there into a free space and may get into the further gap 313, along the rotor 307, through the motor gap 311. What is advantageous about this is that the ball bearings do not have vapor flowing around them, so that bearing lubrication remains within the closed-off ball bearings rather than being drawn through the motor gap. It is also ensured that the ball bearing is not moistened but remains in the state defined during installation.

In a further embodiment, the motor housing as shown in FIG. 4 is mounted, in the operating position of the heat pump, on top of the condenser housing 114, so that the stator is located above the radial impeller and the vapor flow 310 moves from the top downward through the motor gap and the further gap.

In addition, the heat pump includes the bearing portion 343 configured to support the motor shaft in relation to the stator. In addition, the bearing portion is arranged such that the rotor 307 and the stator 308 are arranged between the bearing portion and the radial impeller 304. This has the advantage that the bearing portion 343 may be arranged within the vapor area inside the motor housing and that the rotor/stator may be arranged below the maximum liquid level 322 (FIG. 3), where the highest dissipation power arises. Thus, an ideal arrangement is provided by means of which every area is located within that medium which is best for said area in order to achieve the purposes, namely motor cooling on the one hand, and convective shaft cooling, on the other hand, and possibly ball-bearing cooling, which will be addressed below with reference to FIG. 10.

Figure 10:
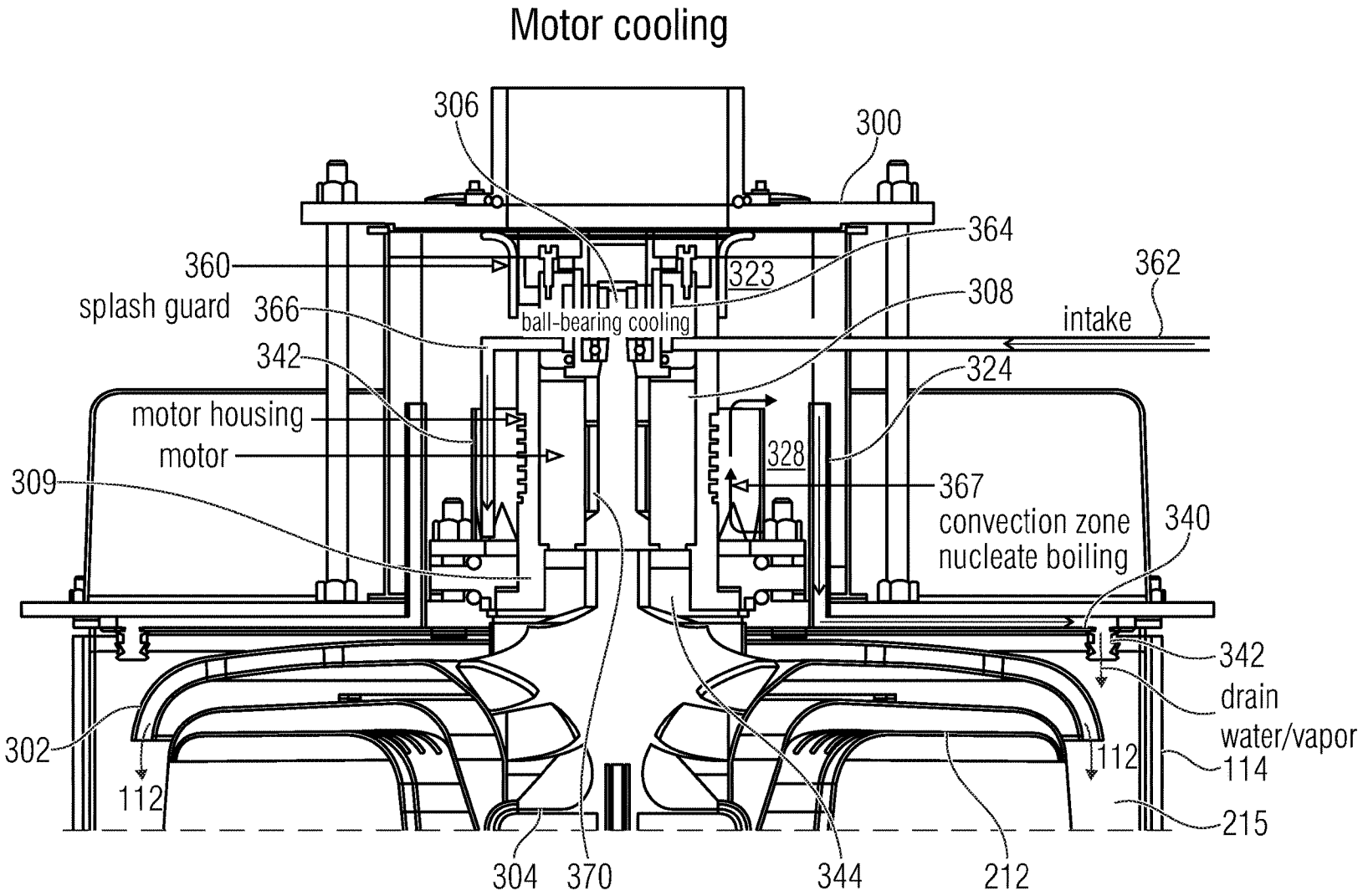
FIG. 10 shows a heat pump in accordance with an embodiment, comprising convective shaft cooling in accordance with the first aspect and motor cooling in accordance with the second aspect, particular emphasis being placed upon motor cooling.

The motor housing further includes the working medium intake 330 for directing liquid working medium from the condenser to a wall of the compressor motor for cooling the motor. FIG. 10 shows a specific implementation of said working medium intake 362, which corresponds to the intake 330 of FIG. 3. Said working medium intake 362 extends into a closed volume 364 representing a ball-bearing cooling unit. The ball-bearing cooling unit has a discharge channel exiting therefrom which includes a small pipe 366 which does not direct the working medium at the top onto the volume of the working medium 328, as shown in FIG. 3, but directs the working medium at the bottom to the wall of the motor, i.e. to the element 309. In particular, the small pipe 366 is configured to be arranged within the convection element 342 arranged around the motor wall 309, specifically at a certain distance, so that a volume of liquid working fluid exists within the convection element 342 and outside the convection element 342 within the motor housing 300.

Due to nucleate boiling on the grounds of the working medium which is in contact with the motor wall 309, in particular in the lower area, where the fresh working medium intake 366 ends, a convection zone 367 arises within the volume of working liquid 328. In particular, the boiling bubbles are hurled from the bottom upward due to nucleate boiling. This results in continuous "stirring", to the effect that hot working liquid is brought from the bottom to the top. The energy caused by the nucleate boiling is then transferred to the vapor bubble, which then ends up within the vapor volume 323 above the liquid volume 328. The pressure arising there is introduced directly into the condenser via the overflow 324, the overflow extension 340 and the drain 342. Thus, continuous removal of heat, which occurs mainly due to the discharge of vapor rather than due to discharge of heated liquid, takes place from the motor into the condenser.

This means that the heat, which actually is the waste heat of the motor, advantageously ends up, due to the vapor discharge, precisely where it is supposed to be, namely in the condenser water to be heated. Thus, the entire motor heat is maintained within the system, which is particularly favorable for heating applications of the heat pump. However, also for cooling applications of the heat pump, discharge of heat from the motor into the condenser is favorable since the condenser is typically coupled to efficient heat dissipation, e.g. in the form of a heat exchanger or of direct heat removal within the area to be heated. Therefore, no motor waste heat device of its own needs to be provided, but the heat dissipation from the condenser to the outside, which takes place from the heat pump anyway, is also taken advantage of, as it were, by the motor cooling unit.

The motor housing is further configured to maintain, during operation of the heat pump, the maximum level of liquid working medium and to provide the vapor space 323 above the level of liquid working medium. The vapor feed inlet is further configured to communicate with the vapor space, so that the vapor within the vapor space is directed, for the purpose of convective shaft cooling, through the motor gap and the further gap in FIG. 4.

In the heat pump shown in FIG. 10 and FIG. 4, the drain is arranged as an overflow within the motor housing so as to direct liquid working medium that is above the level into the condenser and to further provide a vapor path between the vapor space and the condenser. Advantageously, the drain 324 is both, namely both overflow and vapor path. However, said functionalities may also be implemented by an alternative implementation of the overflow, on the one hand, and of a vapor space, on the other hand, while using different elements.

In the embodiment shown in FIG. 10, the heat pump includes a particular ball-bearing cooling unit configured, in particular, such that the sealed-off volume 364 containing liquid working medium is configured around the bearing portion 343. The intake 362 enters into said volume, and the volume has a drain 366 from the bail-bearing cooling unit into the working medium volume for cooling the motor. Thus, a separate ball-bearing cooling unit is provided which extends around the ball bearing on the outside rather than inside the bearing, so that even though said ball-bearing cooling unit achieves efficient cooling, the lubricant filling of the bearing is not impaired.

As is further shown in FIG. 10, the working medium intake 362 includes, in particular, the line portion 366, which extends almost to the base of the motor housing 300 and/or to the bottom of the liquid working medium 328 within the motor housing or which extends at least to an area located below the maximum level so as to discharge, in particular, liquid working medium from the ball-bearing cooling unit and to feed the liquid working medium to the motor wall.

FIG. 10 and FIG. 4 further show the convection element which is arranged within the liquid working medium such that it is spaced apart from the wall of the compressor motor 309 and which is more permeable to the liquid working medium in a lower area than in an upper area. In particular, in the embodiment shown in FIG. 10, the upper area is not permeable and the lower area is relatively highly permeable, and in the implementation, the convection element is configured in the form of a "crown", which is placed upside down into the volume of liquid. Thus, the convection zone 367 may be configured as it is depicted in FIG. 10. However, alternative convection elements 342 may be used which in some manner are less permeable at the top than at the bottom. For example, one might use a convection element that has holes at the bottom which in terms of shape or number have a larger cross section for passage than holes in the upper area. Alternative elements for producing the convection flow 367 as depicted in FIG. 10 may also be used.

To ensure operation of the motor in the event of a bearing problem, the emergency bearing 344 is provided which is configured to secure the motor shaft 306 between the rotor 370 and the radial impeller 304. In particular, the further gap 313 extends through a bearing gap of the emergency bearing or advantageously through bores deliberately introduced into the emergency bearing. In one implementation, the emergency bearing is provided with a multitude of bores, so that the emergency bearing itself represents as little flow resistance as possible to the vapor flow 10 for the purposes of convective shaft cooling.

Figure 11:
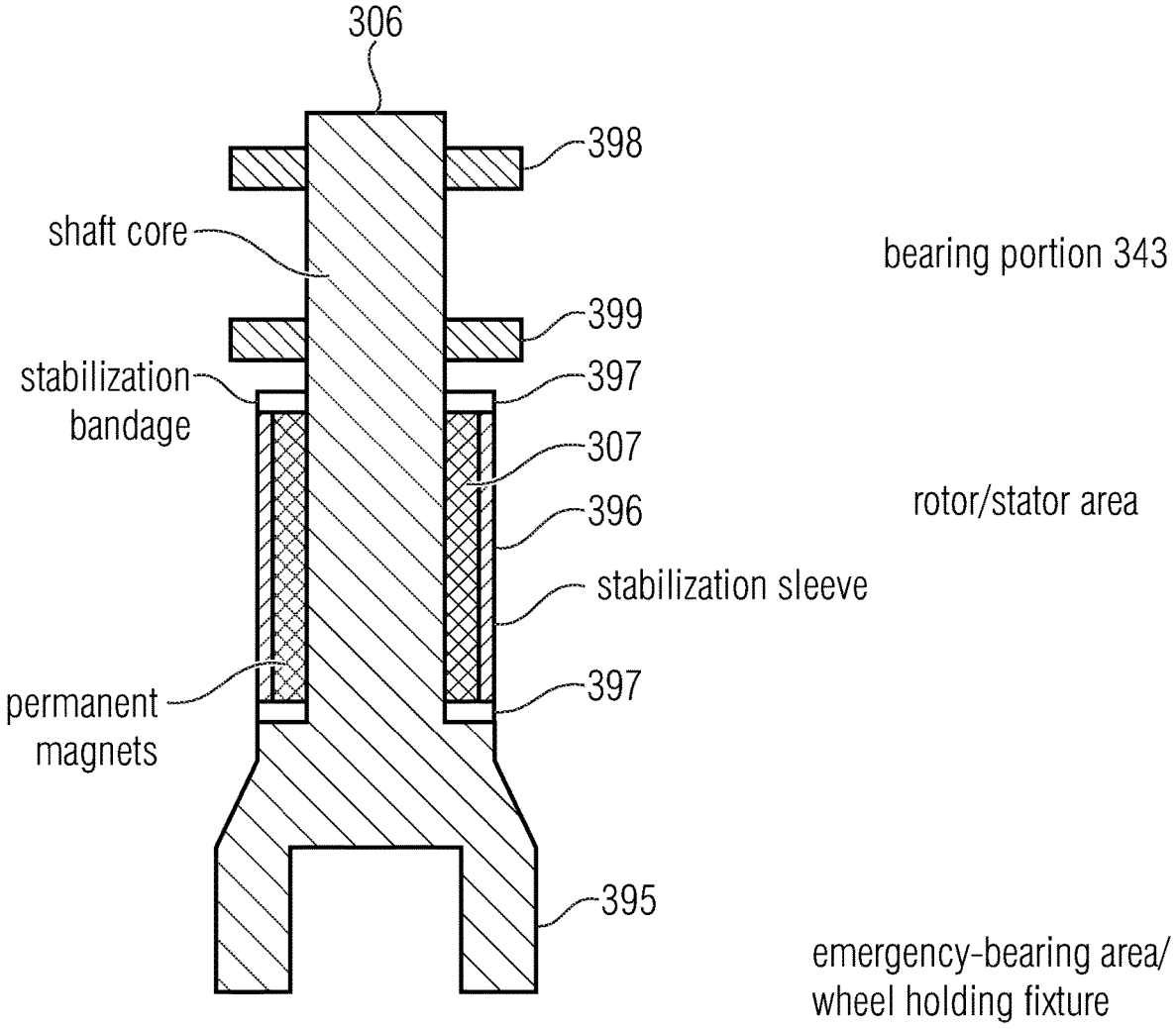
FIG. 11 shows a cross section through a motor shaft comprising a bearing portion in accordance with embodiments of the present invention.

FIG. 11 shows a schematic cross section through a motor shaft 306 as may be employed for advantageous embodiments. The motor shaft 306 includes a hatched core as depicted in FIG. 11 and which is supported by advantageously two ball bearings 398 and 399 in its upper portion representing the bearing portion 343. Further down on the shaft 306, the rotor is configured with permanent magnets 307. Said permanent magnets are placed upon the motor shaft 306 and are held by stabilization bandages 397 which are advantageously made of carbon. In addition, the permanent magnets are held by a stabilization sleeve 396, which is also advantageously configured as a carbon sleeve. Said securing or stabilization sleeve results in that the permanent magnets reliably stay on the shaft 306 and cannot become detached on account of the very high centrifugal forces caused by the high rotational speed of the shaft.

Advantageously, the shaft is formed of aluminum and has an attachment portion 395 which is fork-shaped in cross section and represents a holding fixture for the radial impeller 304 when the radial impeller 304 and the motor shaft are not configured integrally but as two elements. If the radial impeller 304 is integrally formed with the motor shaft 306, the wheel holding fixture portion 395 will not be there, but the radial impeller 304 will directly adjoin the motor shaft. The emergency bearing 344, which advantageously is also formed of metal, and in particular of aluminum, is also located in the area of the wheel holding fixture 395, as may be seen from FIG. 10.

Specific advantageous embodiments of the second aspect regarding motor cooling will be presented below with reference to FIG. 10. In particular, the motor housing 300, which is also depicted in FIG. 3, is configured to maintain a pressure which is 20% larger, at the most, than the pressure present within the condenser housing during operation of the heat pump. In addition, the motor housing 300 may be configured to maintain a pressure so low that during heating of the motor wall 300 due to operation of the motor, nucleate boiling takes place in the liquid working medium 328 and within the motor housing 300.

Advantageously, the bearing portion 343 is arranged above the maximum liquid level, so that even in the event of a leak of the motor wall 309, no liquid working medium may get into the bearing portion. By contrast, that area of the motor which at least partly includes the rotor and the stator is located below the maximum level since in the bearing area, on the one hand, but also between the rotor and the stator, on the other hand, the largest amount of dissipation power occurs, which may be transported off in an optimum manner by means of convective nucleate boiling.

As is shown in FIG. 4, in particular, the overflow 324 is configured such that it comprises a first tube portion protruding into the motor housing, such that it further comprises a second line portion 340 extending from a curve portion 317 to a drain 342, which is further arranged outside an area wherein the routing space 302 introduces working vapor, which has been compressed by the compressor wheel 304, into the condenser.

Figure 9:
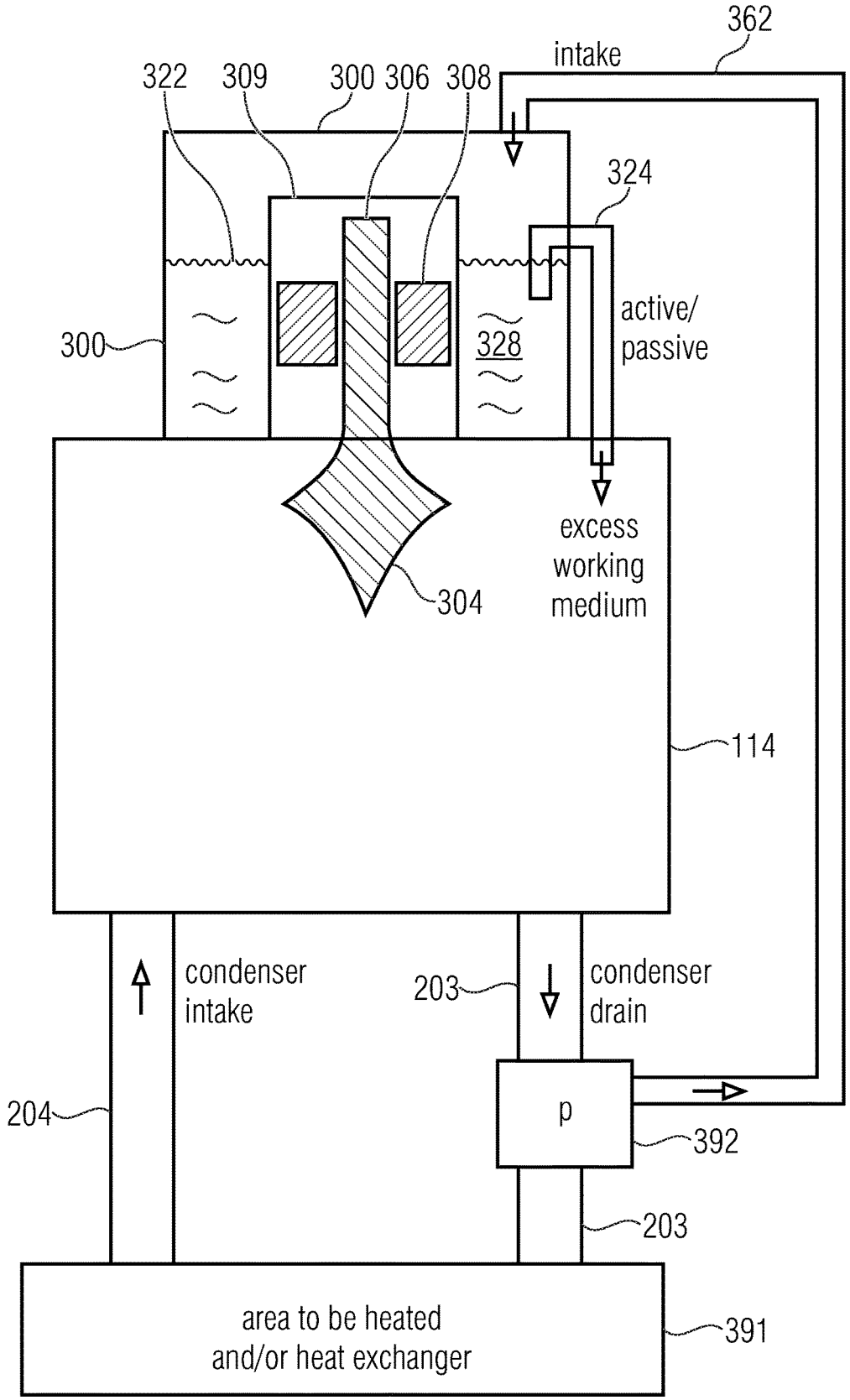
FIG. 9 shows a schematic representation of a heat pump comprising motor cooling in accordance with the second aspect.

FIG. 9 further shows a schematic representation of the heat pump for cooling the motor. In particular, the working medium drain 324 is configured as an alternative to FIG. 4 or FIG. 20. The drain need not necessarily be a passive drain but may also be an active drain which is controlled, e.g., by a pump or another element and which draws off some working medium from the motor housing 300 as a function of detection of the level 322. Alternatively, a re-closable opening might also be located, instead of the tubular drain 324, at the base of the motor housing 300 so as to allow a controlled amount of working liquid to drain from the motor housing into the condenser by briefly opening the re-closable opening.

FIG. 9 further shows the area to be heated and/or a heat exchanger 391, starting from which a condenser intake 204 extends into the condenser, and from which a condenser drain 203 exits. In addition, a pump 392 is provided for driving the circulation of the condenser intake 204 and the condenser drain 203. Said pump 392 advantageously has a branching-off to the intake 362, as is schematically shown. Consequently, no dedicated pump is required, but the pump, which is present anyway, for the condenser drain also drives a small part of the condenser drain into the intake line 362 and, thus, into the volume of liquid 328.

In addition, FIG. 9 shows a general representation of the condenser 114, of the compressor motor comprising the motor wall 309, and of the motor housing 300 as was also described by means of FIG. 3.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Heat pump comprising:

a condenser comprising a condenser housing;

a compressor motor mounted on the condenser housing and comprising a rotor and a stator, the rotor comprising a motor shaft which comprises a compressor wheel for compressing working medium vapor mounted thereon, and the compressor motor comprising a motor wall;

a motor housing which surrounds the compressor motor and comprises a working medium intake so as to direct liquid working medium out of the condenser to the motor wall for cooling the motor, wherein the motor housing is configured to maintain a maximum level of liquid working medium within the motor housing during operation of the heat pump, wherein the motor housing is further configured to form a vapor space above the maximum level during operation of the heat pump, and wherein the motor housing further comprises a vapor discharge outlet for discharging vapor from the vapor space within the motor housing into the condenser.

2. Heat pump as claimed in claim 1, wherein the motor housing is configured to maintain, at a maximum, a pressure which is higher by 20% than the pressure within the condenser housing during operation of the heat pump, or wherein the motor housing is configured to maintain a pressure which is so low that upon heating of the motor wall due to operation of the motor, nucleate boiling takes place in the liquid working medium within the motor housing.

3. Heat pump as claimed in claim 1, wherein the compressor motor further comprises a bearing portion by means of which the rotor is supported in relation to the stator, and wherein the compressor motor is arranged within the motor housing such that the bearing portion is located above the maximum level of liquid working medium, or wherein the compressor motor is arranged within the motor housing such that an area of the motor which at least partly comprises the rotor and the stator is arranged below the maximum level of liquid working medium.

4. Heat pump as claimed in claim 1, wherein the motor wall is provided with cooling ribs which are arranged within the motor housing such that at least some of the cooling ribs are arranged below the maximum level at the liquid working medium.

5. Heat pump as claimed in claim 1, wherein the vapor discharge outlet is configured as an overflow protruding into the motor housing and defining the maximum level, the overflow extending from the motor housing into the condenser, and the overflow further representing a vapor passage for vapor from the vapor space into the condenser, so that the pressures prevailing within the motor housing and the condenser housing are essentially the same.

6. Heat pump as claimed in claim 1, wherein the motor housing comprises a convection element arranged therein which extends within the liquid working medium and is spaced apart from the wall of the compressor motor and from a wall of the motor housing and is more permeable to the liquid working medium in a lower area than in an upper area.

7. Heat pump as claimed in claim 6, wherein the convection element is crown-shaped, wherein an area of the convection element which comprises crown teeth defines the lower area, and wherein the upper area of the convection element is non-permeable to the liquid working medium.

8. Heat pump as claimed in claim 6, wherein the convection element is configured and arranged such that the upper area extends up to or beyond the maximum level.

9. Heat pump as claimed in claim 1, wherein the vapor discharge outlet comprises an overflow within the motor housing so as to direct the liquid working medium that is above the maximum level of liquid working medium into the condenser and to provide a vapor path between the vapor space and the condenser.

10. Heat pump as claimed in claim 1, wherein the working medium intake comprises a line portion which is configured to direct the liquid working medium out of a sealed-off volume, and wherein the line portion extends through the liquid working medium within the motor housing so as to feed the liquid working medium within the line portion to a base of the motor housing.

11. Heat pump as claimed in claim 1, wherein the motor shaft comprises:

a shaft core;

a magnet area comprising permanent magnets attached on the shaft core;

a securing sleeve which is arranged around the magnet area and serves to secure the permanent magnets, wherein the compressor motor is mounted within the motor housing such that the magnet area is positioned below the maximum level of liquid working medium.

12. Heat pump as claimed in claim 1, wherein the motor housing is configured to maintain a pressure which is at least equal to the pressure within the evaporator, or wherein the working medium intake is configured to spray the liquid working medium from the condenser onto the motor wall for cooling the motor, or wherein the motor housing is further configured to direct the liquid working medium that is above the maximum level of liquid working medium into the condenser.

13. Heat pump as claimed in claim 1, wherein a motor gap is configured between the rotor and the stator, and wherein the motor housing is configured to keep the liquid working medium away from the motor gap.

14. Method of producing a heat pump comprising: a condenser comprising a condenser housing; a compressor motor mounted on the condenser housing and comprising a rotor and a stator, the rotor comprising a motor shaft which comprises a compressor wheel for compressing working medium vapor mounted thereon, and the compressor motor comprising a motor wall; a motor housing which surrounds the compressor motor and comprises a working medium intake so as to direct liquid working medium out of the condenser to the motor wall for cooling the motor, the method comprising:

configuring the motor housing such that it maintains a maximum level of liquid working medium within the motor housing during operation of the heat pump and that it forms a vapor space above the maximum level during operation of the heat pump; and arranging a vapor discharge outlet within the motor housing for discharging vapor from the vapor space within the motor housing into the condenser.

15. Method of operating a heat pump comprising; a condenser comprising a condenser housing; a compressor motor mounted on the condenser housing and comprising a rotor and a stator, the rotor comprising a motor shaft which comprises a compressor wheel for compressing working medium vapor mounted thereon, and the compressor motor comprising a motor wall; a motor housing which surrounds the compressor motor and comprises a working medium intake so as to direct liquid working medium out of the condenser to the motor wall for cooling the motor, the motor housing being configured to maintain a maximum level of liquid working medium within the motor housing during operation of the heat pump, and the motor housing being further configured to form a vapor space above the maximum level during operation of the heat pump, the method comprising:

during operation of the heat pump, discharging vapor from the vapor space within the motor housing into the condenser.

* * * * *